US005941233A

United States Patent [19]

Grinols et al.

[11] Patent Number: 5,941,233

[45] Date of Patent: Aug. 24, 1999

[54] INDIRECT-FIRED HEATER WITH REGENERATION RECLAIM ROTARY HEAT EXCHANGES

[75] Inventors: Daniel L. Grinols, Eagan; Craig L. Carney, South St. Paul; Ronald J. Prekker, Independence, all of Minn.

[73] Assignee: Rupp Industries, Inc., Burnsville, Minn.

[21] Appl. No.: 09/128,211

[22] Filed: Aug. 3, 1998

[51] Int. Cl.[6] ..... F24H 3/02

[52] U.S. Cl. ..... 126/110 R; 126/116 R

[58] Field of Search ..... 126/110 R, 116 R

[56] References Cited

U.S. PATENT DOCUMENTS

| | | | |
|---|---|---|---|
| 3,695,250 | 10/1972 | Rohrs et al. . | |
| 4,093,435 | 6/1978 | Marron et al. . | |
| 4,321,961 | 3/1982 | Hemsath . | |
| 4,324,545 | 4/1982 | Hubbert . | |
| 4,345,897 | 8/1982 | Stanton . | |
| 4,384,850 | 5/1983 | Dixon . | |
| 4,426,853 | 1/1984 | Mitani et al. . | |
| 4,427,374 | 1/1984 | Miller . | |
| 4,542,782 | 9/1985 | Berner . | |
| 4,627,485 | 12/1986 | Osborn . | |
| 4,967,726 | 11/1990 | Finch | 126/110 R |
| 5,002,484 | 3/1991 | Lofton et al. . | |
| 5,562,089 | 10/1996 | Astle, Jr. . | |
| 5,590,705 | 1/1997 | Chevalier et al. . | |
| 5,603,906 | 2/1997 | Lang et al. . | |
| 5,664,620 | 9/1997 | Ritter . | |
| 5,732,562 | 3/1998 | Moratalla . | |

*Primary Examiner*—Carroll B. Dority
*Attorney, Agent, or Firm*—Haugen Law Firm PLLP

[57] ABSTRACT

An indirect-fired climate control apparatus for modifying certain aspects or properties of air flowing through a controlled environment, with the apparatus employing a rotary air-energy exchange device with means for bilaterally introducing and extracting energy from primary and secondary air flows. The apparatus includes a feature for recycling portions of the air flow on the primary side so as to more efficiently utilize the energy resource, and deliver this energy to the secondary side. The apparatus is suited for treating air flow with thermal energy for modifying its temperature, as well as energy for controlling the moisture content of the air flow on the secondary side.

5 Claims, 3 Drawing Sheets

10
30
12
11
13
16
15
26
21
25
26
19
20
27
19A

INDIRECT-FIRED HEATER WITH REGENERATION RECLAIM ROTARY HEAT EXCHANGES

BACKGROUND OF THE INVENTION

The present invention relates generally to an indirect-fired climate control apparatus for modifying certain aspects of air flowing through a controlled environment, and more particularly to such an apparatus which employs a rotary energy exchange device with means for bilaterally introducing/extracting energy from the primary and secondary air flows, and wherein means are provided for more efficiently utilizing the energy available in the primary air flow from which energy is introduced to the secondary side.

In the past, rotary energy exchange devices have been employed for use in connection with indirect systems for modifying certain aspects of environmental air, including modification through heating, cooling, humidifying, dehumidifying, and the like. As such, the rotary energy exchange device which rotates through the primary and secondary flows has been normally designated as a "heat wheel". Typically, the rotary energy exchange device utilizes discrete energy exchange means which are located radially outwardly of the axis of rotation of the wheel, and are alternately exposed to primary and secondary air flows wherein energy is introduced into the exchange means on the primary portion of the arcuate travel, and extracted from the exchange means on the secondary portion of travel. In these systems, the primary flow is provided with a means for introducing energy to the system, typically by way of a burner, while the secondary air flow is designed to extract that energy from the exchange means.

In the past, burners have been employed with heat wheels, with the burner output or gases being introduced into the primary air flow. After contacting that portion of the heat wheel within the first or primary air flow, and following extraction of a portion of the energy therefrom, the spent combustion gases are discharged from the system through an exhaust outlet. Inasmuch as there is typically a considerable amount of energy remaining in the combustion air or gases, the present invention provides a system wherein additional energy may be extracted from the combustion air. This is undertaken by creating the primary flow with makeup air or gases from three separate sources, these being fresh outdoor air, gaseous discharge from the combustion burner, and with a third component being recycled from partially spent portion of the combustion air of the second component. Accordingly, the charge of air which includes components from the gaseous output of the burner, together with other components is recycled in order to extract an additional quantity of energy from that portion of the combustion air. The additional utilization of the recycled component reduces the energy input otherwise required from the burner, while maintaining the heat wheel in an appropriate environment for performing its step in the overall operation. By way of further example, the recycled component may be blended with incoming fresh outdoor air, or alternatively, the three components may be blended at a point downstream from the burner output.

SUMMARY OF THE INVENTION

Briefly, the present invention is directed to an indirect-fired heater employing a rotary wheel-type heat exchanger. By way of example, outdoor air from a fresh air intake is heated as it passes through a profile consisting of a direct gas-fired burner. The outdoor air and recycled combustion gases are then blended prior to passage through the gas-fired burner, in order that the gases passing through the burner are at a somewhat higher temperature than the source of outside air. This blend of gases, forming the primary air flow, is then passed through the primary half of the heat wheel. As the wheel continues its rotational excursions, the heat introduced in the primary side is transferred to the secondary side, with the secondary side containing a flow of air into which heat is transferred, and thereafter forced or distributed into a building environment. Since a portion of the air on the primary side of the system is a recycled component downstream from the wheel, it will be recognized that only a portion of the heat energy available in the primary air is generated from the burner, with a significant amount of thermal energy being taken from the recycled component. In order to maintain appropriate combustion conditions, a suitable fractional amount of fresh outdoor air is continually introduced into the burners while an equal amount of stale or combustion air from which a portion of the oxygen has been depleted is exhausted to the outdoors. The recycled component provides for retention and utilization of a certain amount of primary regeneration air while reducing the amount of cold fresh primary air that must utilize energy to become heated to a condition appropriate to support combustion.

In a heat exchange application, the system has alternate application in, for example, a moisture extraction operation. In such an arrangement, a burner is utilized to heat individual ones of the discrete energy exchange means such as silica gel, with the elevation in temperature serving to eliminate or otherwise drive off a portion of the moisture absorbed in the media of the exchange means.

Therefore, it is a primary object of the present invention to provide an improved climate control apparatus which is useful for modifying certain aspects of an environment, and wherein a rotary heat wheel is utilized to bilaterally receive energy from a primary flow, and to discharge the energy so introduced into a secondary flow, and wherein a portion of the primary flow is recycled and reused in order to ultimately conserve the quantity of energy required to support the overall operation.

It is yet a further object of the present invention to provide a climate control apparatus in the form of an indirect-fired heater utilizing a recirculation system wherein a portion of the gaseous output of an indirect-fired heater is recycled in order that available energy in the recycled portion may be reclaimed.

Other and further objects of the present invention will become apparent to those skilled in the art upon a study of the following specification, appended claims, and accompanying drawings.

IN THE DRAWINGS

DESCRIPTION OF THE PREFERRED EMBODIMENT

Figure 1:
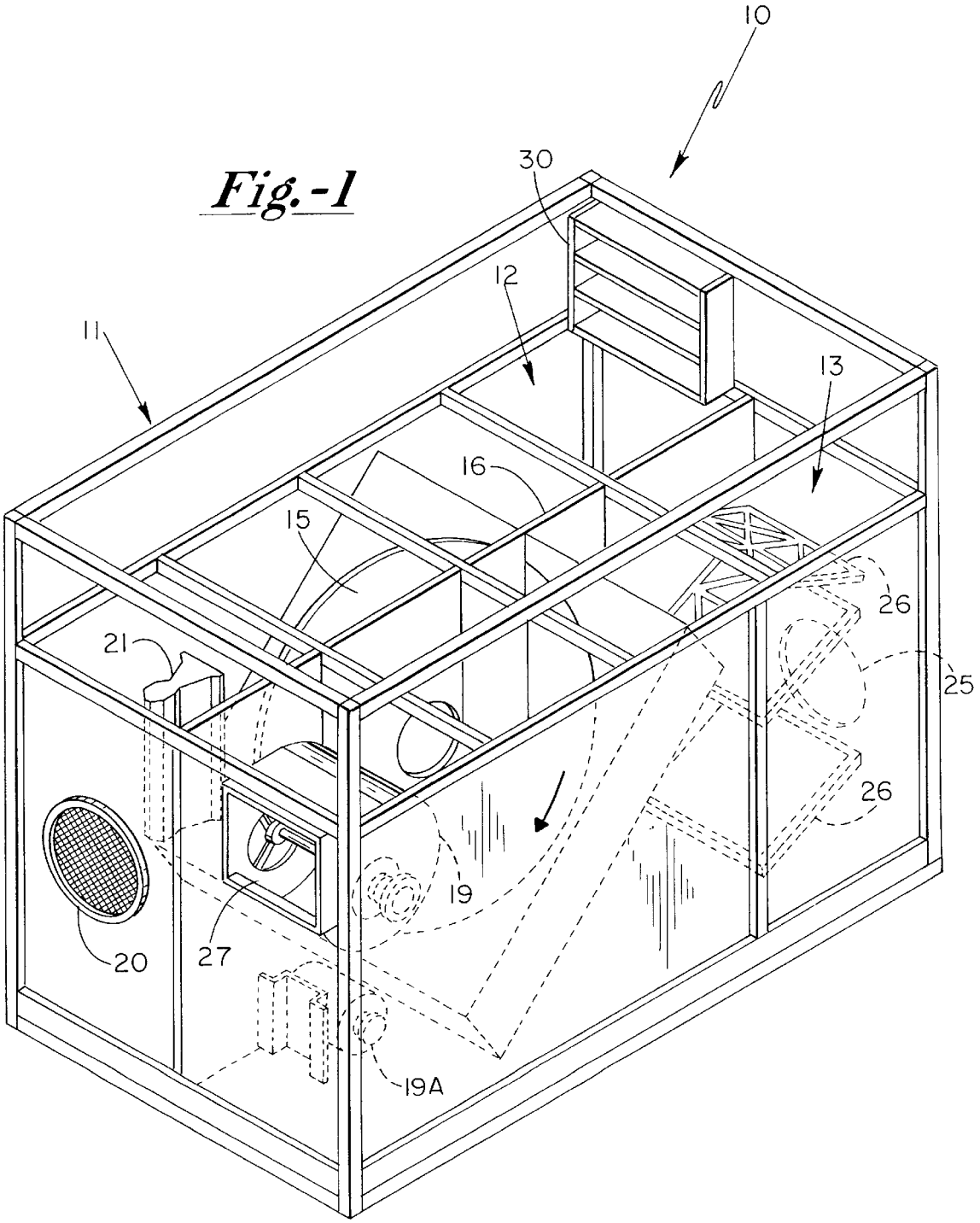
FIG. 1 is a perspective view of a climate control apparatus or system employing the features of the present invention, and illustrating a perspective view of an enclosure in which a rotary heat wheel is mounted, and wherein primary and secondary air flows are moved through the enclosure while contacting appropriate and relevant arcuate segments of the rotary heat wheel.
Figure 2:
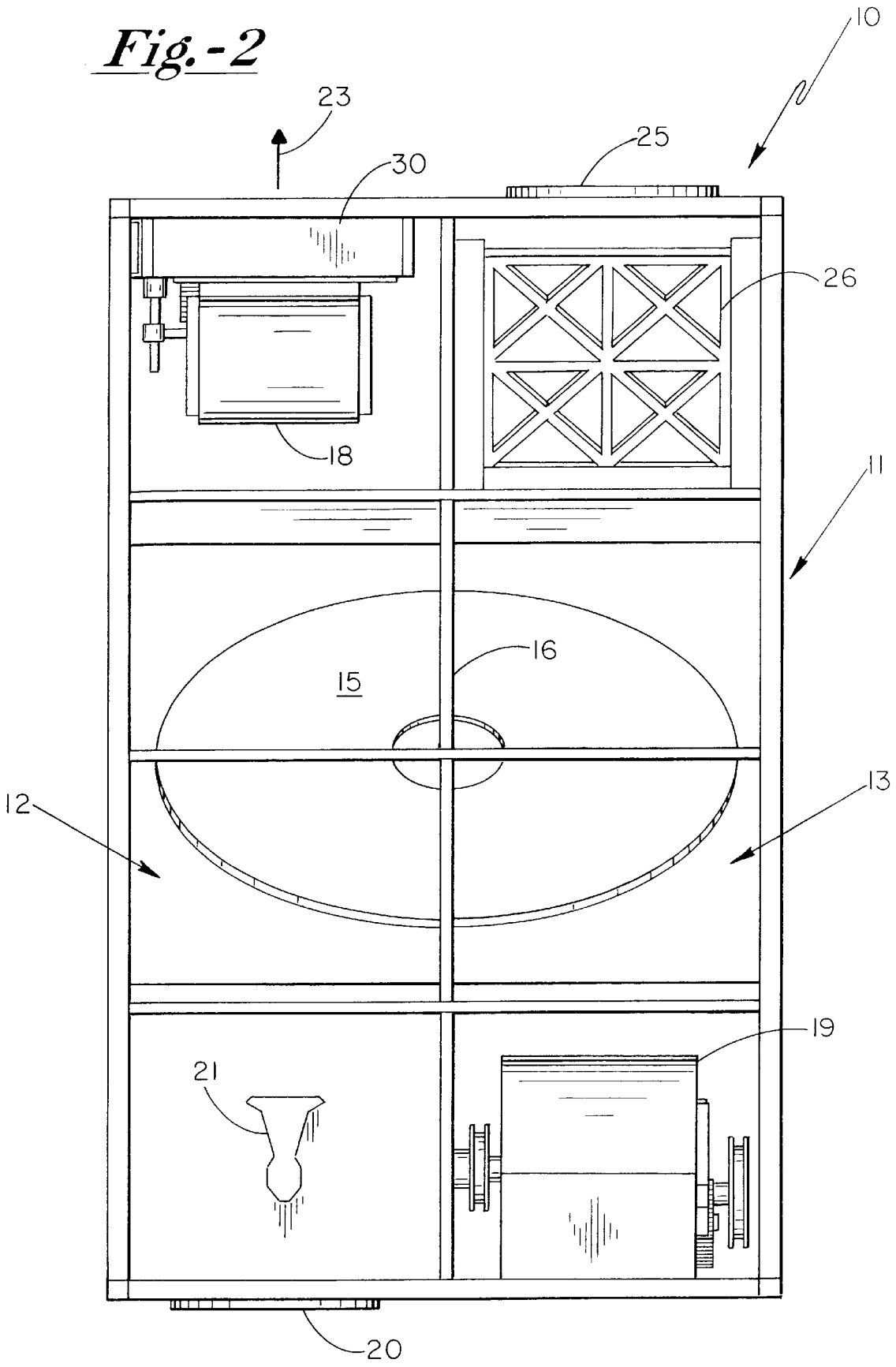
FIG. 2 is a top elevational view of the enclosure illustrated in FIG. 1.

In accordance with the preferred embodiment of the present invention and with attention being directed to FIGS.

1 and 2 of the drawings, the climate control apparatus or system generally designated 10 includes a main enclosure 11 through which a pair of discrete primary and secondary air flows are passed. The system 10 is designed to modify certain aspects of secondary air flowing to and from an environment, such as through the addition of heat or thermal energy to that flow. Enclosure 11 is divided into a pair of chambers including major chambers 12 and 13, with chamber 12 being designed to handle direct and otherwise create a primary flow of air, and with chamber 13 being designed to control and modify (heat) a secondary flow of air passing therethrough. A rotary energy exchange device in the form of a heat wheel generally designated 15 is provided for axial rotation between the primary and secondary major chambers, with wheel 15 incorporating discrete energy exchange means disposed radially outwardly from the axis, and with heat wheel 15 being powered for rotation by a motor, not shown. These discrete energy exchange means are provided for bilaterally receiving on the one hand and delivering on the other hand, energy which is delivered into the primary air flow.

Rotary heat wheels have been utilized in the past, with such wheels being disclosed in U. S. Pat. 4,093,435 (Marron et al.). The '435 patent discloses a rotary regenerative heat energy exchanger which incorporates discrete webs of aluminum foil as an energy exchange means for transfer of sensible heat with minimal pressure drop across and through the thickness of the exchange portions of rotary heat wheel.

A longitudinal bulkhead is provided as at 16 in order to separate the primary chamber 12 from the secondary chamber 13. As is indicated, heat wheel 15 rotates about its axis with approximately one-half or 180° of wheel 15 being exposed on the primary side 12 with the balance being exposed to the air flow in the secondary side 13.

A means is provided for creating primary and secondary air flows, with blower 18 being provided on the primary side 12, and with blower 19 being provided on the secondary side 13 and is powered by motor 19A. Blowers 18 and 19 create the means for moving and/or transferring the primary and secondary air flows through the system.

With attention now being directed specifically to the primary side 12, a fresh air intake 20 is provided, with appropriate filters therein for the passage of fresh outdoor air into the system. Burner profile 21 is interposed within the primary chamber 12, and receives fresh air through inlet 20, along with a charge of partially spent recycled air from the primary air flow side. The flow of air from heat profile 21 is, in turn, passed across the arcuate segment housed within the primary chamber 12, and ultimately through blower 18 where a portion of the air is discharged to the atmosphere along the line and in the direction of the arrow 23.

As has been indicated, only a portion of the air from the primary side 12 is discharged to atmosphere, with a significant portion being recycled back to the burner profile chamber where the remaining energy, unspent in the excursion through heat wheel 15, may be further reclaimed. In a typical operation, the recycled component may constitute between 75% and 95% of the overall primary air, with the desired amount depending, of course, upon the immediate conditions. Suffice it to say that the oxygen content of the primary air entering the burner profile must be at least about 10% to 20% oxygen.

With attention being maintained to the primary side 12, baffles as illustrated at 30 are provided for controlling diversion of the primary air flow, and with baffles 30 accordingly forcing a portion of the primary air back to the zone occupied by burner profile 21. It will be appreciated that other devices or components may be utilized to create the flow diversion, with such devices being, of course, known to those of conventional skill in the art.

With attention being directed to the secondary side 13 of the system 10, environmental air enters the system through inlet 25, passing through filters 26 for the removal of dust and other contaminants, and ultimately into and through the heat wheel portion rotating within the secondary chamber 13. It is in this portion of the chamber that energy is extracted from heat wheel 15, with the treated air being moved through and passed outwardly through outlet port or opening 27 and returned back to the environment being controlled.

Figure 3:
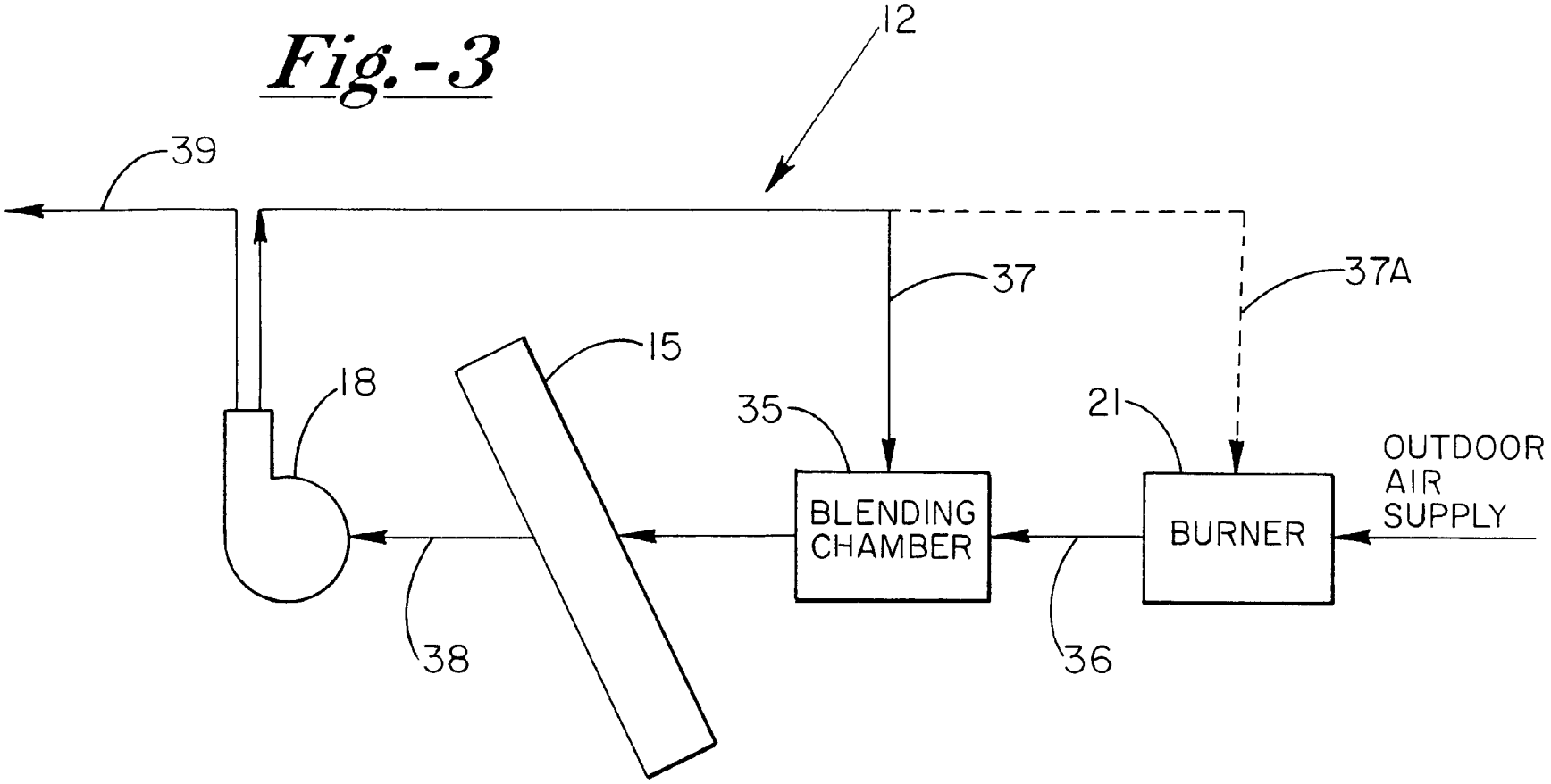
FIG. 3 is a schematic diagram illustrating the path taken by that portion of the primary air flow into which energy is being introduced for transfer to the rotary heat wheel.

With attention now being directed to FIG. 3 of the drawings, the primary side 12 of the system 10 is illustrated, with a flow of outdoor air being supplied to burner profile 21 as indicated. Burner profile 21 is designed to discharge gases to blending chamber 35, with chamber 35 receiving a charge of gases including combustion gases as indicated along line 36, and a flow of recycled primary air or gases as at 37. Alternatively, blending chamber 35 may be eliminated in a system design wherein phantom flow line 37A directs recycled gases directly to burner profile 21 to be blended with incoming fresh outdoor air prior to passing through burner profile 21.

Following blending, the primary air is passed through a 180° segment of rotary heat wheel 15. After passing through heat wheel 15, the primary air moves along the line indicated at 38 through blower 18, and with a portion being ultimately diverted into exhaust air as at 39, and with the balance becoming recycled air as at 37.

In a typical operational example, outdoor air may enter the system at, for example, 0° F. and thereafter be blended with recycled air so that its temperature reaches a level of between about 50° F. and 70° F. This blended gas is then passed through the profile 21 and heated to 200° F. These heated gases are then passed across the primary side of the heat wheel where the flow is cooled to a temperature of, for example, 70° F. After passing through the heat wheel, about 20% of the primary air is exhausted to atmosphere, with the remaining 80% being redirected back to the profile burner. Fresh outdoor air is added continuously in an amount equal to that being exhausted.

By way of further explanation, when 500 cubic feet of air enters the system at 0° F., this amount is blended with recycled combustion gases to achieve a temperature of 60° F. This system accordingly is capable of providing sufficient energy to maintain the 7000 cubic foot output of secondary air entering the secondary chamber at a temperature of 70° F., and ultimately being discharged in a flow at a temperature of 140° F.

As an alternative to the thermal treatment of secondary air, the system of the present invention is readily adapted for use in a dehumidifying application. In this instance, the heat wheel is provided with energy exchange means in the form of hygroscopic substances such as silica gel or the like. Moisture picked up from the secondary side is driven off upon exposure to the higher temperature gases on the primary side, and thus replenishing the ability of the silica gel to extract moisture from air passing through the heat wheel on the secondary side.

It will be appreciated that the description herein is for illustrative purposes only and is not to be construed as a limitation upon the scope of the claims to which the invention is entitled.

What is claimed is:

1. Climate control apparatus for modifying certain aspects of air flowing to and from an environment and incorporating a rotary energy exchange device with discrete energy exchange-means positioned radially outwardly from the axis of rotation for absorption of energy from a primary air flow and for bilateral discharge of energy into said secondary air flow; said climate control apparatus comprising:

(a) a burner and means for creating primary and secondary air flows;

(b) an enclosure with primary and secondary chambers therein and adapted for passage of said primary and secondary air flows respectively therethrough and with the rotary portion of said energy exchange device providing for alternate exposure of said discrete energy exchange means to only one or the other of said primary and secondary air flows, a blending chamber within said enclosure for receiving air from said environment;

(c) said primary air flow having a first blower means and consisting of multiple components including a primary component of outdoor air, and a secondary component from the discharge of said burner;

(d) said burner having a fresh air supply in communication with the said primary air flow and diverter means mounted within said primary chamber downstream from said rotary energy exchange device for dividing said primary air flow into an exhaust component to atmosphere and into a third component to be delivered to said blending chamber; and (e) said secondary air flow chamber having an input end for receiving a charge of makeup air from said environment and said third component from said blending chamber and forming said secondary air flow and a discharge end for exhausting treated air into the environment being controlled, and a chamber intermediate said input and output ends for exposure of said secondary air flow to said rotary energy exchange device within said secondary chamber.

2. The climate control apparatus as defined in claim 1 being particularly characterized in that said energy exchange device is aluminum foil.

3. The climate control apparatus as defined in claim 1 being particularly characterized in that said energy exchange device comprises silica gel.

4. The climate control apparatus as defined in claim 1 being particularly characterized in that said third component comprises between 75% and 95% of the overall primary air.

5. The climate control apparatus as defined in claim 1 being particularly characterized in that the oxygen content of primary air entering said burner profile is greater than 10%.

* * * * *